US005995795A

United States Patent [19]

Berlin

[11] Patent Number: 5,995,795

[45] Date of Patent: Nov. 30, 1999

[54] ELECTROPHOTOGRAPHIC PRINTING APPARATUS AND METHOD

[75] Inventor: Genady Berlin, Tel Aviv, Israel

[73] Assignee: Elfotek Ltd., Rosh Ha'Ayin, Israel

[21] Appl. No.: 09/000,552

[22] Filed: Dec. 30, 1997

[51] Int. Cl.[6] ..... G03G 15/14; G03G 21/00

[52] U.S. Cl. ..... 399/313; 399/159; 430/67; 430/69

[58] Field of Search ..... 399/313, 159; 430/57, 60, 66, 67, 69

[56] References Cited

U.S. PATENT DOCUMENTS

| | | | |
|---|---|---|---|
| 4,251,612 | 2/1981 | Chu et al. | 430/67 X |
| 4,731,313 | 3/1988 | Haneda | 430/42 |
| 4,803,514 | 2/1989 | Hiratsuka et al. | 430/42 X |
| 5,162,184 | 11/1992 | Aizawa | 430/67 X |
| 5,374,978 | 12/1994 | Asanae et al. . | |
| 5,432,033 | 7/1995 | Asanae et al. | 430/35 |
| 5,514,507 | 5/1996 | Yagi et al. | 430/67 X |
| 5,546,169 | 8/1996 | Wada et al. . | |
| 5,656,406 | 8/1997 | Ikuno et al. | 430/67 |
| 5,665,502 | 9/1997 | Ohashi et al. | 430/62 |
| 5,697,025 | 12/1997 | Tokimatsu et al. | 399/159 |
| 5,707,767 | 1/1998 | Yu | 430/67 X |
| 5,722,013 | 2/1998 | Nagase et al. | 399/112 |
| 5,725,983 | 3/1998 | Yu | 430/66 X |
| 5,754,210 | 5/1998 | Haneda et al. | 399/39 X |

*Primary Examiner*—Richard Moses

*Attorney, Agent, or Firm*—Foley & Lardner

[57] ABSTRACT

Electrophotographic printing apparatus is described, particularly useful for printing a plurality of copies from a single latent electrostatic image, in which the toner transfer system includes a multi-layer transfer photoreceptor having an outer dielectric layer, an inner electrically-conductive layer, and an intermediate photoconductive layer forming an interface with the outer dielectric layer. A charging system charges the outer surface of the outer dielectric layer of the transfer photoreceptor with charges of one polarity to facilitate the transfer of the toner image from the recording photoreceptor to the record member, and produces in the interface, between the photoconductive layer and the outer dielectric layer, charges of the opposite polarity to maintain the charges of said one polarity on the outer surface of the transfer photoreceptor. The transfer photoreceptor may also serve to transport the record member and to separate the record member from the recording photoreceptor. In the described apparatus, the recording photoreceptor is also of a multi-layer construction including an outer dielectric layer, an inner electrically-conductive layer, and an intermediate photoconductive layer forming an interface with the outer dielectric layer. The imaging device produces a latent electrostatic image of one polarity on the outer surface of the outer dielectric layer of the recording photoreceptor; and a charging system produces a charge pattern of the opposite polarity in the interface of the recording photoreceptor to maintain the latent electrostatic image on the outer dielectric layer of the recording photoreceptor during the printing of a plurality of copies.

37 Claims, 8 Drawing Sheets

ELECTROPHOTOGRAPHIC PRINTING APPARATUS AND METHOD

FIELD OF THE INVENTION

The present invention relates to electrophotographic printing or copying apparatus and method. The invention is particularly useful for printing a plurality of copies from a single exposure, and is therefore described below with respect to such apparatus and method, but it will be appreciated that features of the invention could also be used for printing single copies from each exposure.

BACKGROUND OF THE INVENTION

Electrophotography is currently the dominant copying and digital printing technology. The electrophotographic process is usually described as a cyclical process consisting of a number of steps. To generate N number of identical copies from the same original, each of the steps in the conventional process must be repeated N times. The steps to be repeated include at least the even charging of a photoreceptor by a charge corona, the recording of the image to be reproduced (create a latent electrostatic image), the development of the exposed image, and the transfer and fixing of the image on the final image carrier. Also repeated are the steps of erasing the residual charge on the photoreceptor and cleaning its surface, before the next recording cycle may begin.

The cyclical nature of the electrophotographic process limits the ability to create high throughput reproduction equipment, since every increase in speed places a heavy burden on the image recording/scanning system and requires extremely high data supply rates. The photoreceptor also suffers from increased cycling fatigue (caused by repetitive, high-speed charge-discharge processes), mechanical wear and tear (caused by the cleaning system) and other drawbacks.

Some of these drawbacks could be eliminated if there would be a possibility to produce a number of copies from a single exposure (single latent electrostatic image). Latent electrostatic image storage capability would allow to achieve high printing speed and reduced mechanical wear and tear, since there would be no need to clean the photoreceptor after each printing cycle. The fatigue of the photoreceptor would also be reduced since there would be less charge-discharge and exposure cycles. Furthermore, the independence of the recording process from the printing process would allow each of them to perform at optimal speed.

Latent image storage is, however, problematic in conventional xerography, and printing at different than recording speed is practically impossible. Dark decay current, a phenomenon in which the charge deposited on the photoreceptor dissipates due to the dark current which is always present in the photoreceptor, prevents the retention and maintenance of a stabilized electrostatic latent image throughout all of the copying process steps required to produce a number of copies of the same original image. This is further complicated by the exponential nature of the decay, which adversely affects the very first moments of the deposited charge's life. For example, an amorphous Se photoconductor charged to a surface potential of 700v decays to 600 v. in the first ten seconds following the initial charge deposit. The increasing need in high speed copying and printing equipment forces use of more sensitive photo-conductors, such as SeTe, $As_2Se_3$, etc., that are characterized by an even faster charge relaxation. This makes them unsuitable for latent charge storage/ reproduction of a plurality of images using conventional electrophotographic processes.

Many attempts have been made to use the conventional process to reproduce a plurality of images. U.S. Pat. No. 4,286,865 to Satomi et al, incorporated by reference herein, discloses a copying apparatus which permits, during the automatic copying of a desired number of copies from the same original document, a determination to be made of the number of repeat uses of the same latent electrostatic image. The timing of the formation of successive latent images of the same original document is controlled in accordance with the total number of copies to be made of the same original document, so that the repeat uses of each respective latent image are approximately equal. The preprogrammed electronic control system supports the reproduction of up to 10 copies from a single exposure with reasonable quality. If the number of copies to be made exceeds ten, the quality deteriorates, due to the reasons described above, to an unacceptable level. In order to prevent this, the recording process must be re-repeated.

It is clear that the capabilities of the method disclosed in U.S. Pat. No. 4,286,865 are limited, since the exposure speed (scanning speed) is equal to the process speed, and both are a function of the sensitivity of the photoreceptor layer, which in order to retain the charge for a least ten successive/repetitive copies, cannot be high. As a result of this, the machine's throughput is limited. Another reason for this, as noted above, is the dark charge decay, which is inversely proportional to the photoreceptors' sensitivity. This makes it practically impossible to ensure the same photoreceptor charge level for the first and the tenth copy.

Other attempts have been made of producing a plurality of copies from a single latent image-charge by storing the charge (latent electrostatic image) on a charge retentive layer. Examples of such prior attempts are described in U.S. Pat. Nos. 4,297,422, 4,297,423, 4,297,423, 4,442,191, 4,898,797 and 5,053,304. In these cases, the charge retentive layer is part of a multilayer dielectric photoreceptor structure intended to enable the retention of the charge on the photoreceptor after the transfer operation is completed. However, insofar as we are aware, the techniques described in the above-mentioned patents, despite the complexity of the solutions introduced, have not reached desired results.

Different processes of exposure enabling the creation of a latent electrostatic image on such photoreceptors are also described in the following publications: Nakamura, IEEE TRANSACTIONS ON ELECTRONIC DEVICES, April 1972, pages 405–412; Mitsui, IEEE TRANSACTIONS ON ELECTRONIC DEVICES, April 1972, pages 396–403; and Mark, PHOTOGRAPHIC SCIENCE AND ENGINEERING, May–June 1974, pages 254–261.

Although the reproduction capabilities of the above methods are better than those using a conventional photoreceptor, the number of copies that may be produced from one exposure remains small, and the above methods have not found commercial use insofar as we are aware.

It should be noted that in the multilayer photoreceptors described above, as well as in those in actual use, the dielectric layers, both outer (Canon process) and inner, are usually very thin (2 to 5 microns). These layers may be manufactured by spraying a material solution or casting the material over a substrate, immersing the substrate in a bath with the desired material, or sputtering.

The production of such multilayer structures is a relatively costly process, and these structures do not possess the mechanical strength and durability required to support production of a large number of copies/prints. Despite these shortcomings, these thin multilayer photoreceptors structures are the only available technology that supports the high-speed latent electrostatic image generation required by digital high-speed printing apparatuses. (See the article "Impact of Photoreceptor Design on Digital Electrophotography" by S. Maitra at al, incorporated by reference herein.)

An absolutely necessary condition for producing a plurality of copies from a single exposure is the ability to preserve/sustain the latent image potential relief on the surface of the photoreceptor throughout the entire print run. This condition may generally be satisfied by implementing a contact based electrostatic image from the photoreceptor to the final carrier transfer. A contact roller system, similar to the one described in the above-mentioned patents, is usually used. Alternatively, a belt transfer system with a variety of implementations, as disclosed in the above-cited U.S. Pat. No. 4,286,865, U.S. Pat. No. 5,455,663, U.S. Pat. No. 5,461,461, U.S. Pat. No. 5,469,248 and others, may be used.

In the course of the printing/copying process, the surface of the transfer member (e.g., drum, belt, etc.) which is in contact with the backside of the paper (record member) is continuously charged to a desired charge level and polarity, either directly, or via a regular corotron/scorotron arrangement. The main disadvantage of such a contact transfer device is that it requires a constant charge supply, which causes high energy loss and, in the case of use of a corotron or scorotron device, emission of ozone into the air. The described devices charge the paper as well, and the removal of the static charge requires the use of special paper charge-neutralization devices provided in practically all existing copying/printing electrophotographic equipment. These drawbacks prevent the assurance of an effectively developed image transfer during the production of a plurality of copies from a single exposure, reduce the reliability of the apparatus, and complicate its use.

An additional problem preventing production of a plurality of copies from a single latent electrostatic image is the separation of a record member from the recording photoreceptor. The presently used electrostatically-assisted copy-separation technology cannot be applied in the process of production of a plurality of copies. The AC corona that is used to create an electrical field adversely effects the stored electrostatic latent image on the recording photoreceptor. The existing mechanical separation means, such as separation fingers or rulers, usually contact the outer surface of the recording photoreceptor. This may damage the outer surface of a photoreceptor and mechanically displace toner particles on the recording member and on the photoreceptor.

It is believed that, primarily because of the foregoing shortcomings, the above-mentioned processes for producing a plurality of copies from a single latent image have not been implemented in existing copying/printing apparatus.

There is therefore an urgent need to provide a better multilayer photoreceptor structure and transfer system for transferring the toner image from the recording photoreceptor to the record member which has advantages in the above respects. There is also a need to provide a paper handling system capable of supporting the production of a plurality of copies from a single latent electrostatic image.

BRIEF SUMMARY OF THE PRESENT INVENTION

For purposes of the following description, electrophotographic printing apparatus "as described herein", refers to apparatus, comprising; a recording photoreceptor having an outer surface capable of retaining a latent electrostatic image when formed thereon; an imaging device for producing on the outer surface a latent electrostatic image corresponding to the image to be printed; a toner applicator for applying a charged toner to the outer surface to visually develop the latent electrostatic image as a toner image; a transfer system for transferring the toner image from the recording photoreceptor to a record member; a fixing system for fixing the transferred toner image on the record member; and a cleaning system for cleaning the outer surface of the recording photoreceptor in preparation for receiving another latent electrostatic image to be printed.

According to one aspect of the present invention, there is provided electrophotographic printing apparatus as described herein, characterized in that the transfer system includes a transfer photoreceptor; and a charging system for evenly charging the outer surface of the transfer photoreceptor with charges of one polarity such as to attract the charged toner from the recording photoreceptor to the record member.

More particularly, this transfer photoreceptor is a multilayer construction having an outer dielectric layer, an inner electrically-conductive layer, and an intermediate photoconductive layer forming an interface with said outer dielectric layer; and said charging system charges the outer surface of said outer dielectric layer of the transfer photoreceptor with charges of one polarity of larger magnitude than toner-receiving portions of the latent electrostatic image, for facilitating the transfer of the toner image from the recording photoreceptor to the record member, and for producing in said interface, between the photoconductive layer and the outer dielectric layer, charges of the opposite polarity to maintain said charges of said one polarity on said outer surface of the transfer photoreceptor. In the described preferred embodiments, the transfer photoreceptor serves as the paper handling means, and also the means for separating the record member from the recording photoreceptor after the developed image has been transferred. Particularly good results are obtainable when the transfer photoreceptor is of a laminated construction and is engageable with the record member for pressing it against the outer surface of the recording photoreceptor during the transfer of the toner image therefrom to the record member.

According to another aspect of the present invention, there is provided electrophotographic printing apparatus characterized in that the recording photoreceptor is also of a multi-layer construction. In one described embodiment, it has a laminated light-transmissive outer dielectric layer; and in another described embodiment, it has a laminated opaque dielectric layer.

According to a further aspect of the present invention, there is provided apparatus as described herein, characterized in that the recording photoreceptor is driven at a lower speed when recording the latent electrostatic image than when transferring the toner image to the record member while printing a plurality of copies.

The present invention also provides a method of electrophotographic printing by performing the operations described above with respect to the apparatus.

Further features and advantages of the invention will be apparent from the description below.

BRIEF DESCRIPTION OF THE DRAWINGS

The invention is herein described, by way of example only, with reference to a number of preferred embodiments constructed in accordance with the present invention as shown in the attached drawings, wherein.

DESCRIPTION OF PREFERRED EMBODIMENTS

Figure 1A:
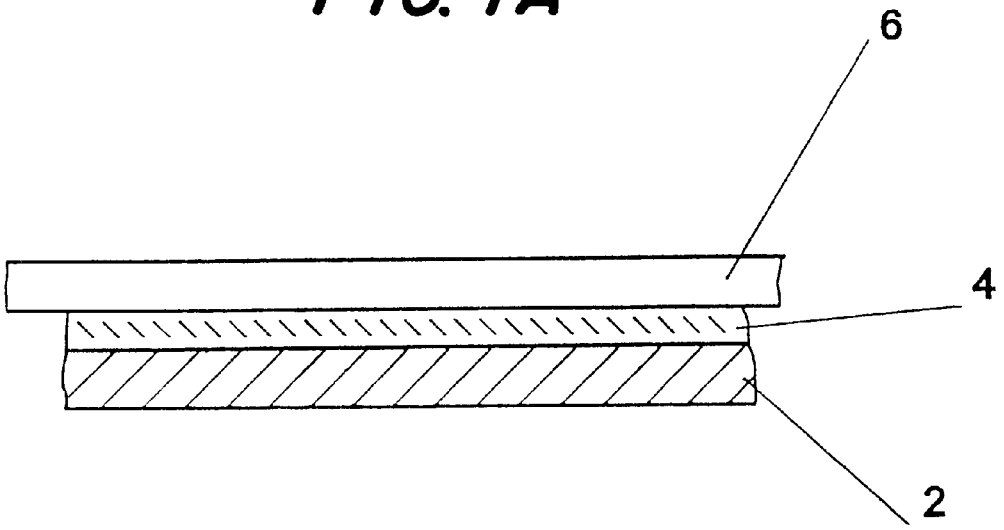
FIG. 1A schematically illustrates a multilayer photoreceptor with a transparent dielectric layer.

FIG. 1A depicts a conceptual representation of the multilayer photoreceptor, with a transparent dielectric coating, that consists of a conductive layer 2, photo-semiconductive layer 4 and a laminating layer 6. Lamination is a process of joining a number of surfaces into one substrate/body which creates hermetic joints usually not sensitive to the changes in environmental conditions. In this particular case, the laminating dielectric layer 6 should be transparent to visible light (or any specific wavelength selected for writing,) with high mechanical strength and durability, such as polycarbonate resin Makrolon™ or polyethylene terephthalate resin (PET) or its equivalent, with thickness of, for example, 20 microns, manufactured by extrusion and laminated over the photoconductive layer 4, deposited on the conductive substrate 2. This laminated layer mechanically protects the photoconductor, typically an amorphous selenium layer having a thickness about 30–50 microns, and reduces environment-dependent parameter changes during operation. The dielectric layer 6 continues to function properly even when an electric breakdown of the photoconductor has taken place.

Figure 1B:
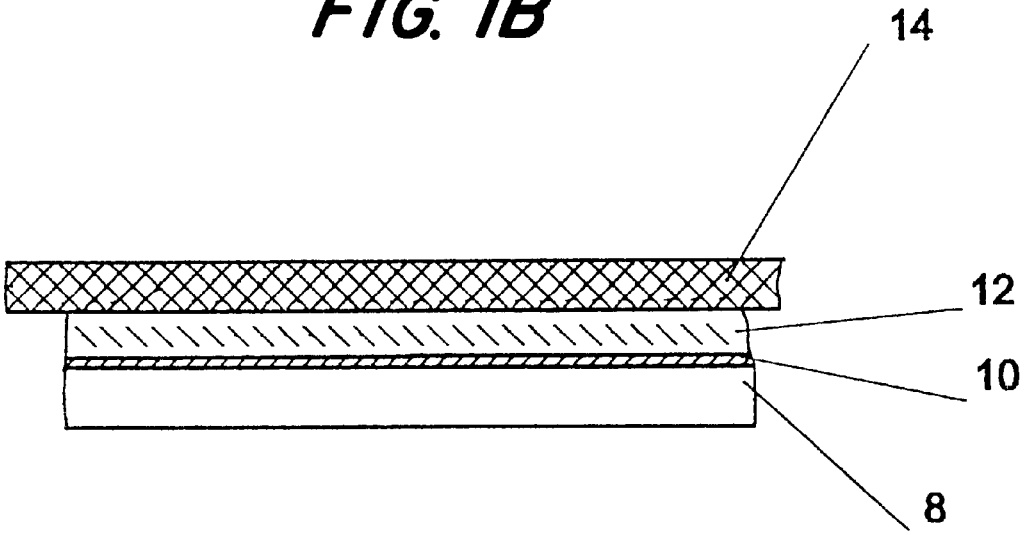
FIG. 1B schematically illustrates the multilayer photoreceptor with an opaque dielectric layer.

FIG. 1B illustrates the structure of a multilayer photoreceptor with an opaque dielectric coating. The photoreceptor consists of a transparent base 8, conductive semitransparent layer 10, photo-semiconductive layer 12 and an opaque dielectric laminating layer 14. The transparent base 8 may be flexible or rigid, made for example of glass or CR-39 material. Accordingly the laminating dielectric layer 14 may be flexible or rigid with improved mechanical strength and durability.

Figure 2A:
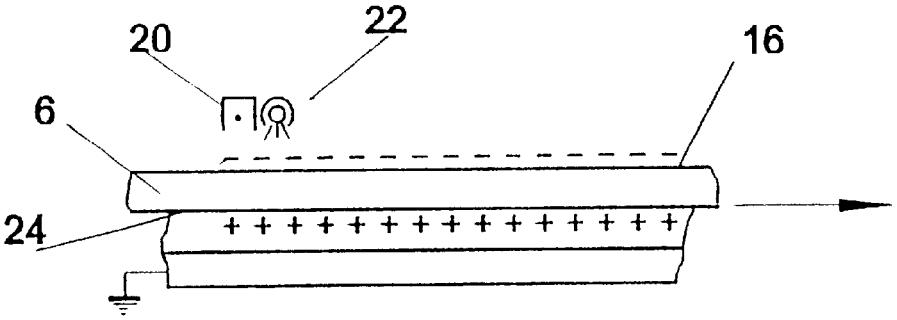
FIGS. 2A–2C illustrate the progressive stages in the generation of a stable latent electrostatic image on the multilayer photoreceptor with a transparent dielectric layer.
Figure 2B:
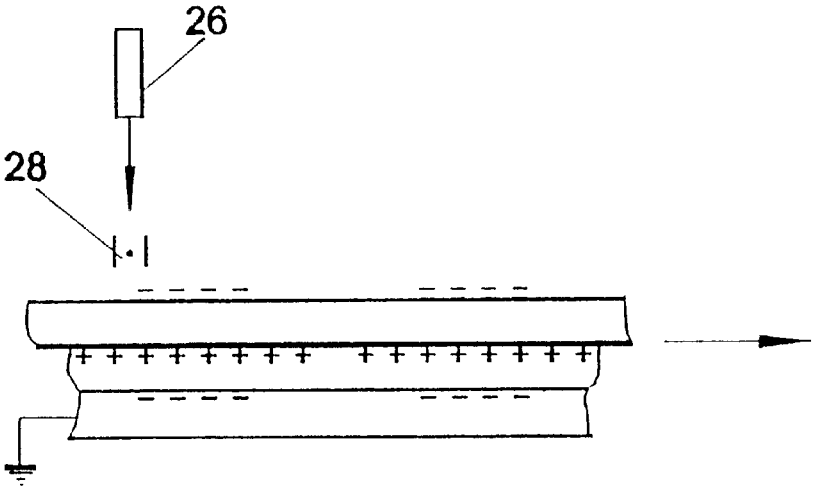
Figure 2C:
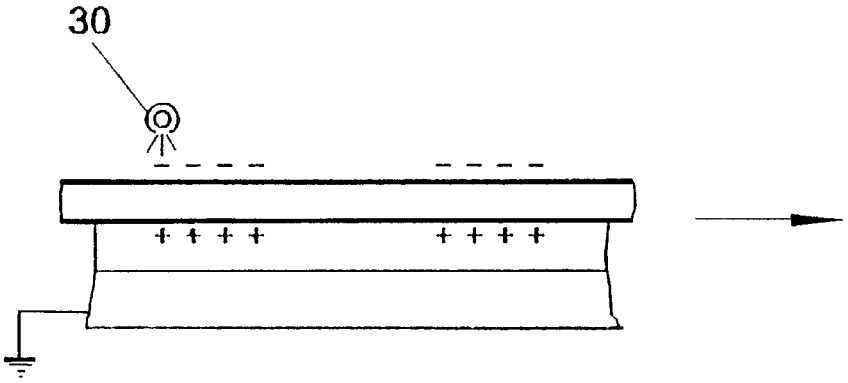

FIGS. 2A, 2B and 2C show the sequence of the generation of a latent electrostatic image on a photoreceptor laminated by a transparent dielectric. The laminated multilayer photoreceptor charging stage is shown in FIG. 2A. The surface 16 of the photoreceptor is uniformly charged by a charge deposition device 20, such as Corotron or Scorotron. The charge deposition on the surface of the laminated multilayer photoreceptor is performed concurrently with the blanket illumination of the active area of the photoreceptor, supplied by a light source 22. This blanket illumination, transmitted by the upper transparent layer 6, makes the photo-semiconductor conductive and enables the injection of a compensation charge with inverse polarity to the one deposited on the surface 16. This compensation charge resides on the photo-semiconductor-dielectric boundary 24. The arrow indicates the direction of the movement of the photoreceptor surface with respect to the charge source and the blanket illumination source to enable un i form charging of the entire surface.

The next stage, shown in FIG. 2B, is a combined and simultaneous image exposure and surface recharge. This stage is actually similar to the one in the Canon NP and/or Katsuragawa processes. The image exposure, indicated by the arrow 26, is performed concurrently, but may be performed at a different time from the surface recharging performed by a charging device 28.) The exposed are as of the laminated multilayer photoreceptor are discharged. The charge remains on the areas corresponding to the dark (not exposed) areas of the image to be reproduced.

Blanket light exposure, supplied by a light source 30 shown in FIG. 2C, is used to create the potential relief on the surface of the photoreceptor. Following this exposure, the system becomes stable and the latent electrostatic image/charge may be kept for a long time, since the charges on the surf ace of the transparent dielectric layer are kept/equalized by charges of opposite polarity, trapped on the boundary of the photo-semiconductor-transparent dielectric layer, and they prevent the discharge of the photo-semiconductor. Thus, no additional means to stabilize and hold the charge are required in the process, and the printing of a reasonable number of copies from the same original exposure may be initiated. This prevents the discharge of the laminated multilayer photoreceptor, and there is no need for any additional measures to keep the charge stable until the last copy of the required run length N is printed, although this depends on the run length.

Figure 3A:
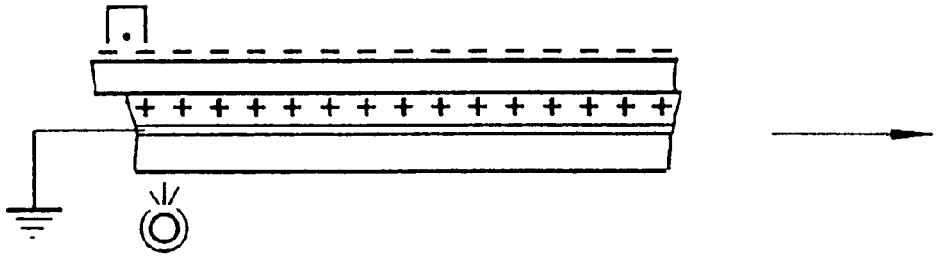
FIGS. 3A–3C illustrate the progressive stages in the generation of a stable latent electrostatic image on the multilayer photoreceptor with an opaque dielectric layer.
Figure 3B:
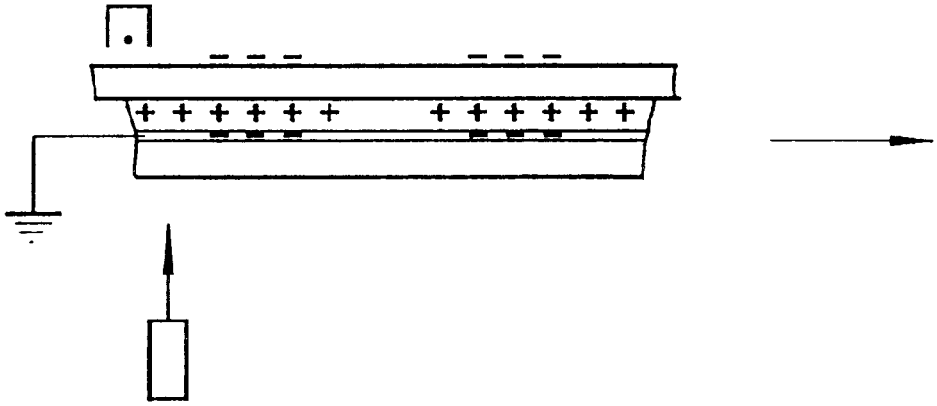
Figure 3C:
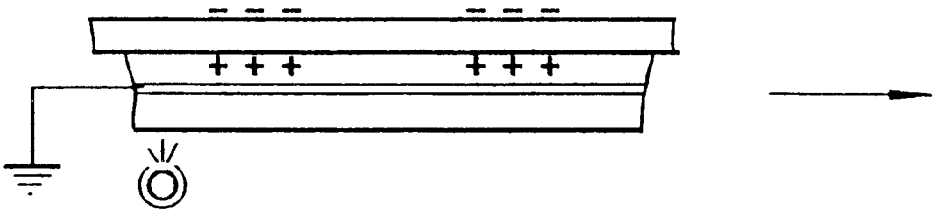

FIGS. 3A–3C illustrate the progressive stages of the generation of a stable latent electrostatic image on the laminated multilayer photoreceptor with an opaque dielectric layer by the suggested electrophotographic process. The stages of formation of the potential relief and the means used in the process are similar to these used with a photoreceptor with a transparent dielectric coating, except that the flood illumination of the photo-semiconductor and image exposure are performed via the transparent substrate and semi-transparent conductive layer.

Figure 4A:
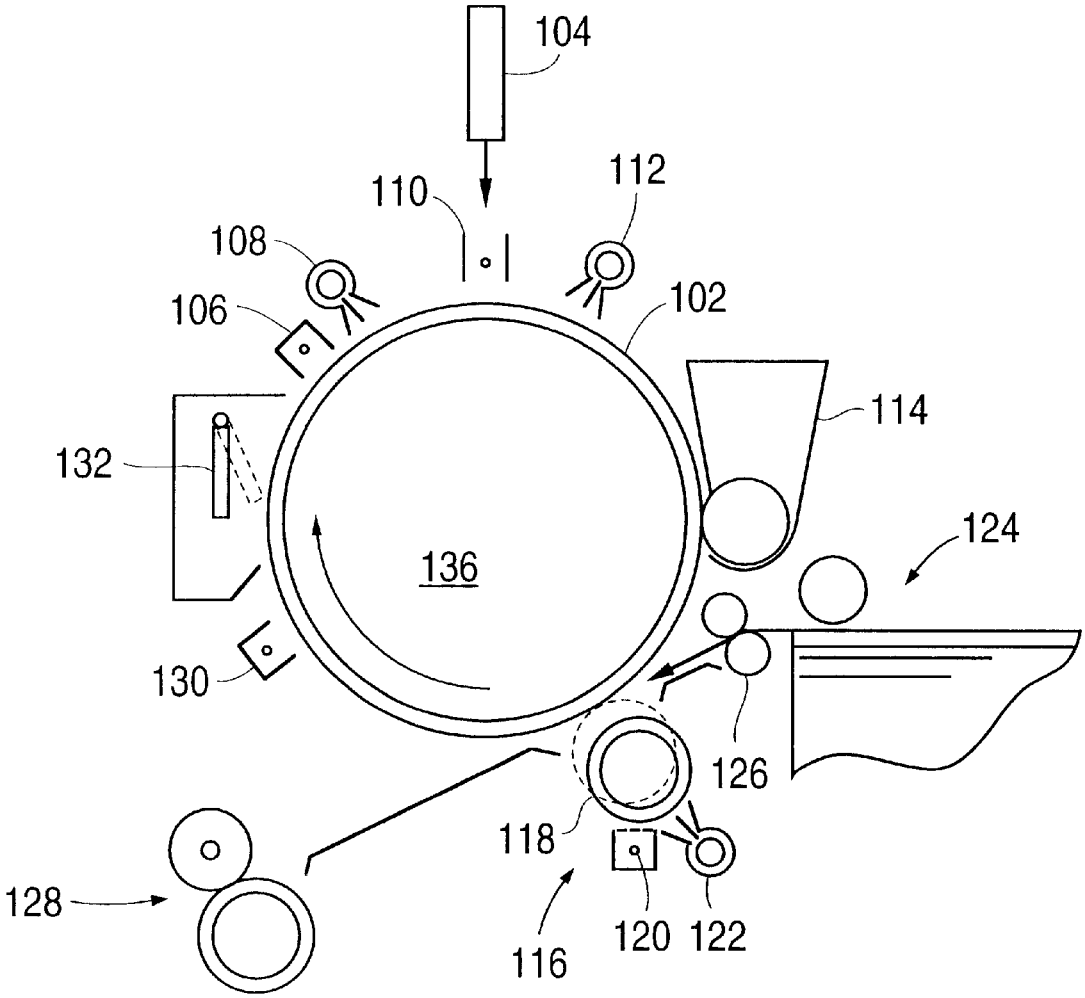
FIG. 4A schematically illustrates the creation of the first of N identical copies to be reproduced by an apparatus having a multilayer recording photoreceptor with a laminated transparent dielectric layer and a transfer photoreceptor with a laminated outer layer that operates according to one of the embodiments of the present invention.
Figure 4B:
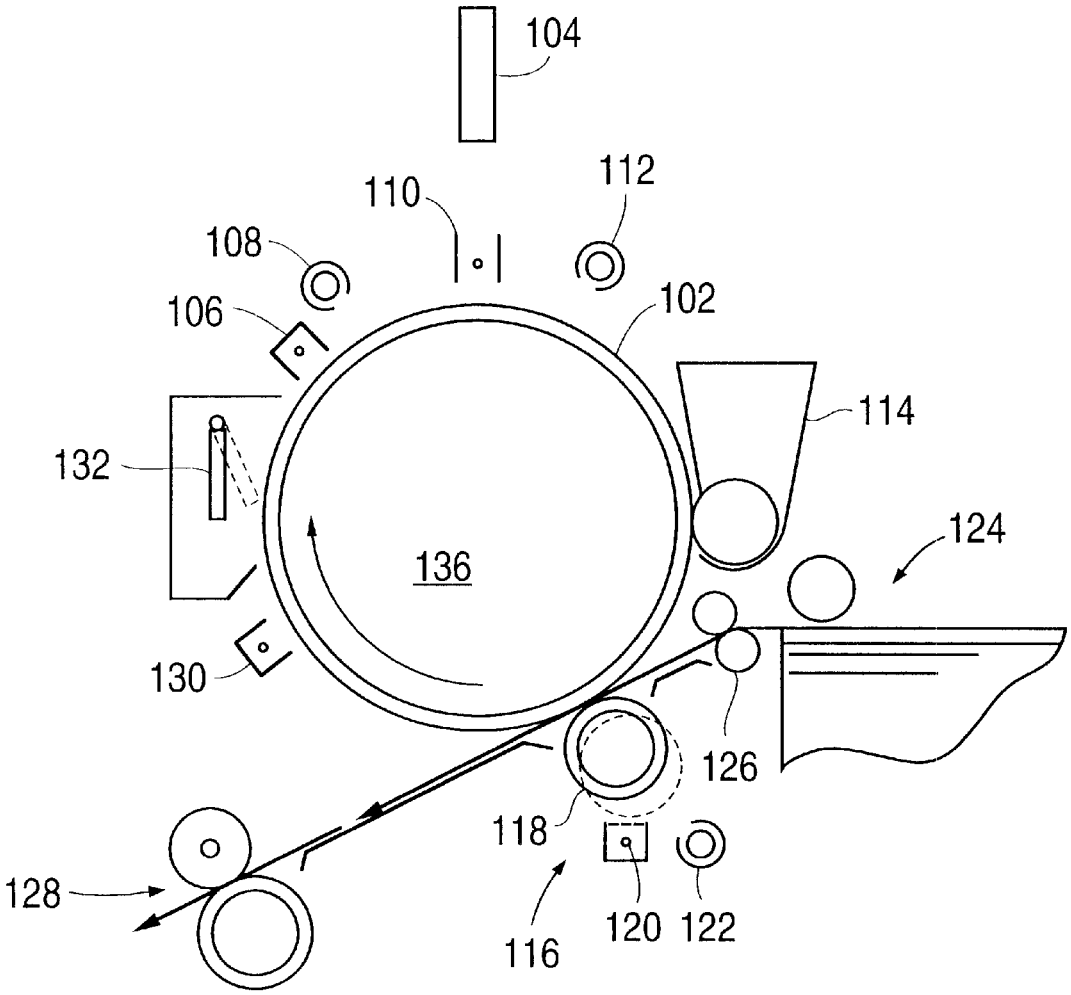
FIG. 4B schematically illustrates the reproduction of the second to (but not including) the last copy using the apparatus of FIG. 4A.
Figure 4C:
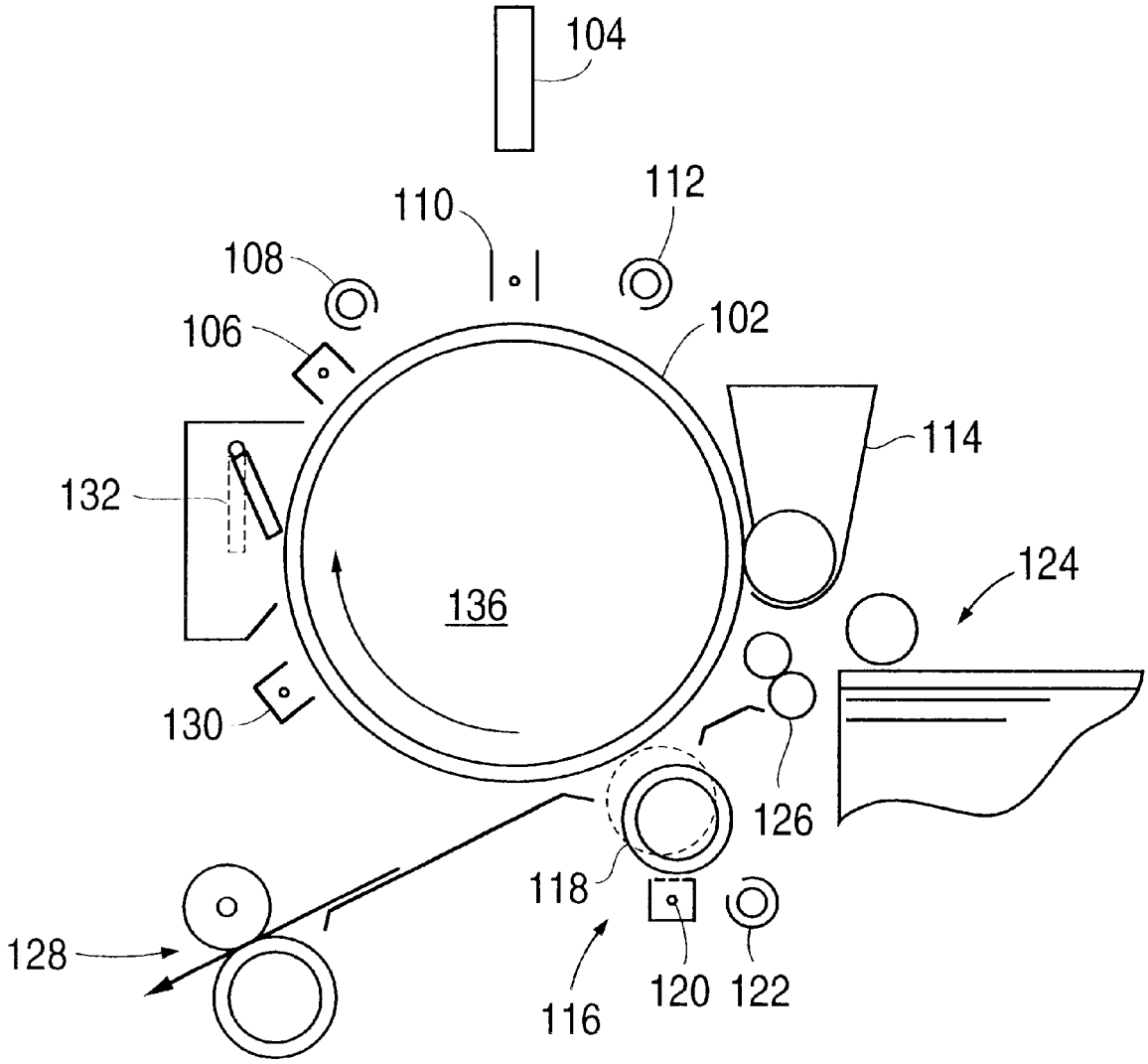
FIG. 4C schematically illustrates the reproduction of the last copy using the apparatus of FIG. 4A FIG. 5 schematically illustrates the creation of the first of a plurality of identical copies to be reproduced by an apparatus having a multilayer photoreceptor with a laminated opaque dielectric and a transfer photoreceptor with a laminated outer layer that operates according to another embodiment of the invention.

FIGS. 4A–4C schematically illustrate one form of apparatus constructed in accordance with the present invention using the above-described multi-layer construction for the recording photoreceptor to produce a plurality of copies from a single latent electrostatic image, and also using the above described multi-layer construction for the transfer photoreceptor to transfer the toner image from the recording photoreceptor to the record members. The apparatus of FIGS. 4A–4C depicts the stages in producing the first copy, the remaining copies up to the last copy, and the last copy, respectively.

Figure 5:
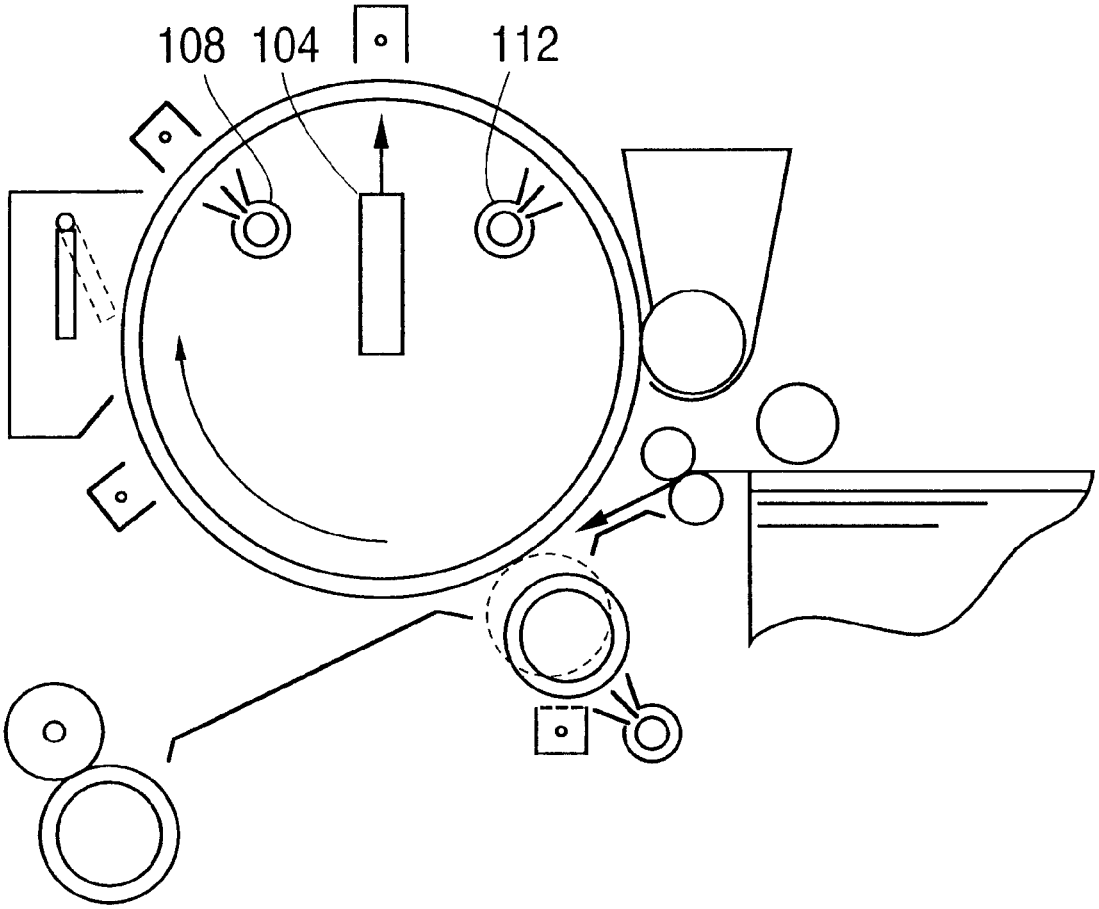

FIG. 5 is a schematic illustration of the apparatus corresponding to that of FIGS. 4A–4C but wherein the recording photoreceptor has an opaque outer dielectric layer.

The apparatus in FIG. 4A includes: a main, laminated image recording photoreceptor 102 on which recording is performed, made of a metal cylinder coated by a photosemiconductor over which a transparent dielectric layer was laminated or hermetically wound; an image exposure system 104, which may be a conventional optical scanning/exposure system or a digital scanning system; a charging device 106; a blanket illumination unit 108; a recharging device (Corotron or a Scorotron) 110; a second blanket illumination unit 112; an image developing section 114; and a contact transfer system 116. The transfer system 116 transfers the toner image from the recording photoreceptor 102 to record members of paper or other record media supplied, by a record member supply system, designated 124. The transfer system includes a transfer multi-layer photoreceptor 118 of the same construction as the recording photoreceptor 102, and as described above with respect to FIGS. 1A–3B. The transfer photoreceptor 118 is also provided with a charger device 120 (Scorotron), and a blanket illumination device 122. The paper or other media supply system 124, includes handling rollers 126, and a thermal image fixing system 128.

The illustrated apparatus further includes a charge neutralizing/erasing device (Corotron) 130, and a blade type cleaning system 132.

Both the auxiliary transfer photoreceptor of the transfer system 118, and the flexible blade type cleaning system 132, have an operating position and an idle position (shown respectively in phantom and solid lines in FIG. 4A), depending on the mode of operation of the apparatus.

The length of the circumference of the main laminated image recording photoreceptor 102 exceeds the maximum length of the image to be printed in the direction of the drum circumference. The length of the circumference of the transfer cylindrical photoreceptor 118 is selected based on required machine constructional sizes. The structure of the transfer photoreceptor may be identical to that of the recording photoreceptor on which the image is recorded, and both are manufactured from the same material and by identical processes.

Thus, the transfer photoreceptor 118 is also of the same multi-layer construction as the recording photoreceptor 102, in that it also includes an outer dielectric layer (corresponding to layer 6, FIG. 1A), an inner electrically-conductive layer (corresponding to layer 2, FIG. 1A), and an intermediate photoconductive layer (corresponding to layer 4, FIG. 1A) forming an interface with the outer dielectric layer. The charger device 120 charges the outer surface of the outer dielectric layer of the transfer photoreceptor 118 with charges on one polarity, and the blanket illumination device 122 renders the photoconductive layer electrically-conductive to inject compensation charges of opposite polarity from the electrically-conductive layer to the interface between the outer dielectric layer and the photoconductive layer in the transfer photoreceptor 118.

The charger device 120 may be of a scorotron type, as there is no need to charge and erase the charge of the auxiliary transfer photoreceptor for each transfer cycle. The transfer photoreceptor 118 should always be charged to a certain constant charge level optimal for toned image transfer, regardless of the residual charge level. It is also well known that the scorotron provides an even potential level of the charged surface, which is required for identical and repeatable transfer conditions over the whole image area.

The charge level of the transfer photoreceptor 118 may vary over a relatively large range, depending on the level of the charge of the latent electrostatic image on the main image recording photoreceptor, the process speed, and the characteristics of the material of the final image carrier. This charge level is established to ensure optimal toner transfer. The charged level in the transfer photoreceptor is of higher magnitude that in the recording photoreceptor. For example, the charge level in the transfer photoreceptor may be from −1000 to −2000 volts, preferably about −1200 volts; whereas in the recorded photoreceptor, it may be between −300 and −1000 volts, preferably about −750 volts.

The electrical properties of the laminated layer enable the use of up to 4 KV of a surface potential of respective polarity without causing damage to the photoreceptor. The laminated photoreceptor of both image recording and transfer cylinder may be implemented as a rigid or flexible structure (the required rigidity may be provided by proper mounting).

FIG. 4A shows the creation of a latent electrostatic image on the outer surface of the transparent dielectric coating of the laminated photoreceptor 102 for reproduction of the first copy of the required N copies of the original. In this mode of operation, the image is recorded on the recording photoreceptor with a speed $V_R$ and, according to the timing diagram of the machine, the charging device 106, blanket illumination unit 108, image exposure system 104 with the recharging device 110, and the second blanket exposure unit 112 are activated. The charging device 120 and the blanket illuminating device 122 are activated concurrently and evenly charge the transfer photoreceptor 118, as shown in FIG. 2A.

The latent electrostatic image on the main image recording photoreceptor, obtained by using this method, is developed and toned in the image developing section 114 by a development device which may be of a magnetic brush type or other suitable development device. The laminated transfer photoreceptor roller 118, that carries a charge of the same polarity as the surface charge of the dielectric layer of the laminated photoreceptor, is in its initial/idle position and not in contact with the photoreceptor 102. As the record member (paper) delivered from the cassette 124 enters the transfer zone, the transfer roller 118 moves towards the drum and presses the paper to the surface of the drum. Following the image transfer, the paper enters the thermal image fixing unit 128, where the image is thermally fixed to the image paper. The blade type cleaning device 132 is not active and is in its idle position during the stages of latent image creation and printing; the charge erasing device 130 is also inactive.

The process of forming the latent electrostatic image on the laminated multilayer photoreceptor, and the process of printing/reproducing the first copy, may be done in different time domains. In this case, the image recording time may be considered set-up time and the printing time may be considered actual reproduction time. The single copy recording time may be as long as necessary [$V_R$ very slow] to record a high quality image, and the printing time may be as short as possible [$V_P$ very large] or supported by the level of the electrophotographic process speed.

FIG. 4B depicts the apparatus of the present invention when the next copy is produced during the next drum rotation. In this case, only the image developing section 114, contact transfer system 116, brought in contact with the imaging photoreceptor 102, media supply system 124, paper/media handling rollers 126 and heat image fixing system 128 are activated and operated at speed $V_P$ (usually faster than the recording speed $V_R$.).

Since the latent electrostatic image created on the surface of the laminated imaging photoreceptor 102 by trapped charges remains practically intact and stable, it may be used to produce the desired number of copies (the process may continue until N−1 copies are produced). The copying process thus resembles the regular offset printing process in which, in each revolution of the impression cylinder, the cylinder is inked and the ink is transferred to paper, producing an impression.

As the charges on the surface of the laminated transfer photoreceptor 118 are held by charges of the opposite sign, located in the interface of the semi-photoconductor-dielectric, there is no charge distortion on the main imaging photoreceptor 102, and the potential relief and level of the latent image charge are preserved for multiple use. An additional benefit of this transfer method is that no charge is transferred to the final record member.

Elimination of the charge discharge devices used in the transfer in system conventional electrophotographic processes that are activated for each printing cycle, leads to a significant reduction in the ozone emission in the described apparatus, as compared to conventional devices. This enables the elimination of special ozone limiting devices, and reduces the size of the printing apparatus.

As indicated, the reproduction of a plurality of copies of the same original may be performed at a speed equal to, or significantly greater than, the recording speed. This is enabled by the complete independence of the recording process that generates the stable latent electrostatic image and the process of printing a plurality of copies using the same stable latent electrostatic image. The relatively low recording speed supports the use of a less sensitive photosemiconductor layer with low dark conductivity and low charge decay, as compared to the previously used thin layers. In this particular case, an amorphous selenium layer with a thickness of about 40 microns laminated over by a dielectric layer of PET with a thickness of about 20 microns, was used.

The independence between the recording and printing processes also enables the recording of the latent electrostatic charge image at a speed lower than the printing speed, and enables the achievement of higher image quality (resolution), without affecting machine throughput. This improvement in image quality is achieved by reducing the dependence of the recording process on the dynamic parameters of the scanning system (required to perform high speed and high quality imaging). Additional benefits are gained by the ability to increase the amount of information contained in digitally recorded images.

FIG. 4C shows the sequence of making the Nth (last copy) of the run. Following reproduction of the last copy, the laminated transfer photoreceptor 118 is distant from the main laminated imaging cylinder 102, that continues to rotate in the direction indicated by arrow 136 and enters the area where the charge erasing corona 130 and the blade type cleaning system 132 are activated. The latent electrostatic image is erased and the drum cleaning device 132 removes the residual toner from the laminated photoreceptor drum 102. This accomplishes the process of printing N identical copies from the same exposure and sets up the apparatus for the next recording-printing cycle.

FIG. 5 is a schematic drawing that shows the creation of the first of N identical copies to be reproduced by an apparatus with a laminated multilayer photoreceptor with an opaque dielectric layer that operates according to one of the embodiments of the proposed method. The sequence of processes that form the latent electrostatic image and the printing of a plurality of copies are similar to the one of the apparatus described on FIGS. 4A–4C. The difference between the two is in the physical position of the functional elements. To ensure the implementation of the electrophotographic processes described on FIGS. 3A–FIG. 3C, when a photoreceptor with an opaque dielectric coating is used, the exposure device 104 and illuminating devices 108 and 112, should be placed on the transparent side of the photoreceptor, i.e. within the inner part of the drum. The opaque dielectric coating may be made of a mechanically strong and durable material with high electrical resistivity, significantly increasing the electrophotographic drum life. The process of printing a plurality of copies from a single latent electrostatic image is identical in both machines. The transfer photoreceptor may be a flexible or a rigid structure.

Figure 6:
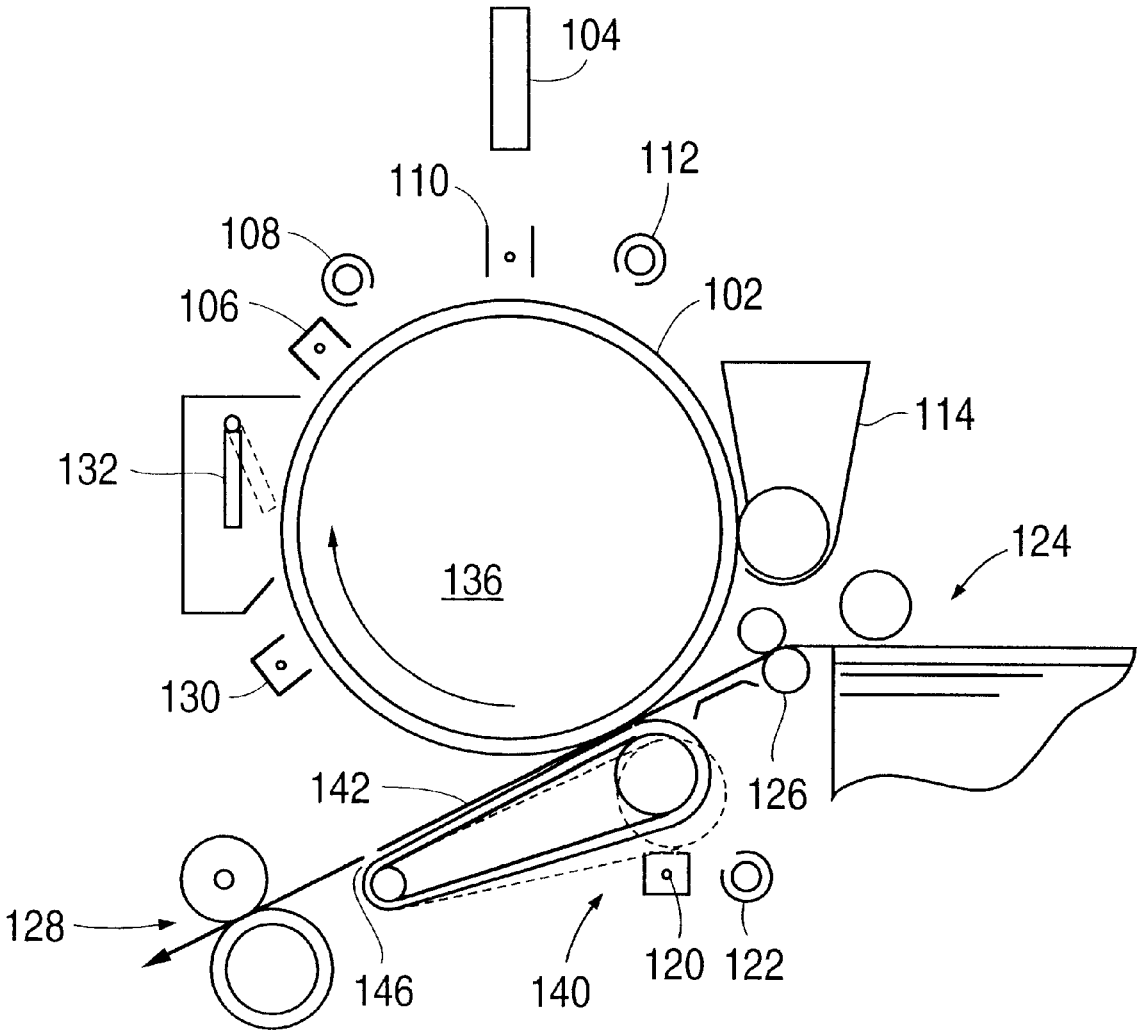
FIG. 6 schematically illustrates printing one of a plurality of identical copies to be reproduced by an apparatus having a multilayer recording photoreceptor with a laminated transparent dielectric layer, and a transfer photoreceptor with a laminated outer layer, implemented as an endless belt, which apparatus operates according to another embodiment of the present invention.

FIG. 6 illustrates an electrophotographic apparatus, basically of the same structure as illustrated in FIG. 4*a* and therefore utilizing the same reference numerals, except that in FIG. 6 the transfer photoreceptor, therein designated 140, is in the form of a flexible member, namely an endless belt. The surface of the transfer photoreceptor belt 140 is charged in the same manner as described above with respect to FIG. 4*a*. The record member, designated 142 in FIG. 6, is paper which adheres to the transfer photoreceptor belt by the electrostatic forces. These forces ensure the separation of the record member from the recording photoreceptor 102. The method illustrated in FIG. 6 thus simplifies the subsequent transport of the record member to the fixing unit 128.

FIG. 6 illustrates mechanical pick-up or separation means 146. Such means however, are used in this case only to separate the record member from the transfer photoreceptor 140, and not from the recording photoreceptor 102. Thus, the mechanical separation means in the arrangement illustrated in FIG. 6 contacts the record member 142 from the side where no toner image is deposited, and thereby prevents toner smear, as well as simplifies the construction of the apparatus. Moreover, the separated record member 142 does not bear any electrical charge since the charges on the surface of the laminated transfer photoreceptor 140 are held by the charges of opposite sign located on the interface of the outer dielectric layer and in the photosemiconductive layer, and such charges cannot migrate to the record member.

The process of reproducing a plurality of copies may be interrupted at any given point in time, and re-activated, as defined by a particular reproduction sequence. The charge erasure and residual toner cleaning processes are always performed after the last copy is printed, setting up the apparatus to print the next image.

The process described may be used in conventional xerographic printing, where each copy to be produced is accompanied by an exposure process, the generation of a latent electrostatic image, and the cyclical repetition of all of the other steps that characterize xerographic processes. The conventional mode of operation may be used in cases when only one reproduction of an original, available in hard copy (or digital form) is required.

The illustrated apparatus may operate at a number of printing speeds, selected as per the optimal conditions for the various steps of the xerographic process. For example, the percentage of image coverage and its color content define toner consumption and consequently the optimal speed of toner delivery required for optimal image development. The weight and heat conductivity of various paper types affects the speed of heat exchange in the thermal fixing device. The paper type, thickness and grain direction affect the stiffness of the material and consequently the detach conditions from the electrophotographic drum, etc. Thus, by analyzing each particular image (and substrate) to be reproduced, it is possible to select and optimize each stage of the electrophotograpic process and to adjust the speed $V_P$ accordingly for production of all of the plurality of copies required by a particular run.

The ability to reduce the latent electrostatic image recording speed, while maintaining high machine throughput (without affecting the apparatus' throughput), allows a reduction of the stringent requirements for the dynamic parameters of the electro-optical scanning system that affect image quality. This also enables the use of less sensitive and easier to manufacture photo-semiconductor layers, characterized by lower dark charge decay, and accordingly, slower potential relief changes and a more stable charge pattern throughout the printing process.

While the invention has been described with respect to several preferred embodiments, it will be appreciated that these are set forth merely for purposes of example only, and that many other variations, modifications and applications of the invention may be made.

What is claimed:

1. Electrophotographic printing apparatus, comprising:

a recording photoreceptor having an outer surface capable of retaining a latent electrostatic image when formed thereon;

an imaging device for producing on said outer surface a latent electrostatic image corresponding to the image to be printed;

a toner applicator for applying a charged toner to said outer surface to visually develop said latent electrostatic image as a toner image;

a transfer system for transferring said toner image from said recording photoreceptor to a record member;

a fixing system for fixing the transferred toner image on said record member;

and a cleaning system for cleaning the outer surface of said recording photoreceptor in preparation for receiving another latent electrostatic image to be printed;

characterized in that said transfer system includes:

a transfer photoreceptor;

and a charging system for evenly charging the outer surface of said transfer photoreceptor with charges of one polarity such as to attract the charged toner from the recording photoreceptor to the record member.

2. The apparatus according to claim 1, wherein:

said transfer photoreceptor is a multi-layer construction having an outer dielectric layer, an inner electrically-conductive layer, and an intermediate photoconductive layer forming an interface with said outer dielectric layer;

and said charging system charges the outer surface of said outer dielectric layer the transfer photoreceptor with charges of said one polarity of larger magnitude than the toner-receiving portions of the latent electrostatic image, for facilitating the transfer of the toner image from the recording photoreceptor to the record member, and for producing in said interface, between the photoconductive layer and the outer dielectric layer, charges of the opposite polarity to maintain said charges of said one polarity on said outer surface of the transfer photoreceptor.

3. The apparatus according to claim 2, wherein said charging system of the transfer photoreceptor includes:

a charger device for charging the outer surface of said outer dielectric layer with said charges of one polarity;

and a blanket illumination device for rendering said photoconductive layer electrically-conductive to inject compensation charges of said opposite polarity from the electrically-conductive layer to said interface between said outer dielectric layer and said photoconductive layer.

4. The apparatus according to claim 1, wherein said transfer photoreceptor is of a laminated construction and is engageable with the record member for pressing it against the outer surface of the recording photoreceptor during the transfer of the toner image therefrom to the record member.

5. The apparatus according to claim 1, wherein:

said recording photoreceptor is also of a multi-layer construction including an outer dielectric layer, an inner electrically-conductive layer, and an intermediate photoconductive layer forming an interface with said outer dielectric layer;

said imaging device produces a latent electrostatic image of one polarity on the outer surface of said outer dielectric layer of the recording photoreceptor; and said apparatus further includes a charging system for producing a charge pattern of the opposite polarity in said interface of the recording photoreceptor to maintain said latent electrostatic image on said outer dielectric layer of the recording photoreceptor.

6. The apparatus according to claim 5, wherein said outer dielectric layer of the recording photoreceptor is a laminated dielectric film.

7. The apparatus according to claim 5, wherein said charging system of the recording photoreceptor includes:

a charger device upstream of the imaging device for depositing on the outer surface of the outer dielectric layer of the recording photoreceptor charges of one polarity;

a first blanket illumination device for rendering said photoconductive layer conductive to inject compensation charges of said opposite polarity from said electrically-conductive layer to said interface between said outer dielectric layer and said photoconductive layer to produce in said interface charges of opposite polarity to the charges on said outer face of the outer dielectric layer of the recording photoreceptor;

said imaging device discharging portions of said outer surface of the outer dielectric layer to produce said latent electrostatic image therein;

a surface re-charger device coincident with said imaging device, which re-charger device neutralizes the charges in the light-exposed portions of the outer dielectric layer of the recording photoreceptor and in the light-exposed interface of the recording photoreceptor, such as to maintain said latent electrostatic image on said outer surface and said charge pattern or said interface patterns produced by the dark portions of said outer surface and interface after exposure by said imaging device;

and a second blanket illumination device downstream of said imaging device for rendering said photoconductive layer of the recording photoreceptor conductive to inject compensation charges of said opposite polarity from the electrically-conductive layer of the recording photoreceptor to said interface between its outer dielectric layer and photoconductive layer to produce said charge pattern of opposite polarity in said interface.

8. The apparatus according to claim 7, wherein said outer dielectric layer of the recording photoreceptor is transparent, and said imaging device, blanket illumination device, and charger device face the outer surface of said transparent outer dielectric layer to form said latent electrostatic image thereon.

9. The apparatus according to claim 7 wherein:

said outer dielectric layer of the recording photoreceptor is opaque, and said electrically-conductive layer is light transmissive;

said imaging device and blanket illumination device face the inner surface of said electrically-conductive layer of the recording photoreceptor;

said charging device faces the outer surface of said outer dielectric layer of the recording photoreceptor; and said recording photoreceptor further includes a transparent base on the inner surface of said electrically-conductive layer.

10. The apparatus according to claim 1, wherein said transfer photoreceptor is also utilized for electrostatic separation of the record member from the recording photoreceptor.

11. The apparatus according to claim 1, wherein said transfer photoreceptor is also used for transporting the record member from the recording photoreceptor.

12. Electrophotographic printing apparatus, comprising:

a recording photoreceptor having an outer surface capable of retaining a latent electrostatic image when formed thereon;

an imaging device for producing on said outer surface a latent electrostatic image corresponding to the image to be printed;

a toner applicator for applying a toner to said outer surface to visually develop said latent electrostatic image as a toner image;

a transfer system for transferring said toner image from said recording photoreceptor to a record member;

a fixing system for fixing the transferred toner image on said record member;

and a cleaning system for cleaning the outer surface of said recording photoreceptor in preparation for receiving another latent electrostatic image to be printed;

characterized in that said recording photoreceptor is of a multi-layer construction having an opaque outer dielectric layer, an inner electrically-conductive layer which is also light-transmissive, and an intermediate photoconductive layer forming an interface with said opaque outer dielectric layer;

said imaging device facing the inner light-transmissive electrically-conductive layer and producing on said outer surface of the outer dielectric layer the latent electrostatic image corresponding to the image to be printed.

13. The apparatus according to claim 12, wherein said imaging device produces a latent electrostatic image of one polarity on the outer surface of the outer dielectric layer of the recording photoreceptor;

said apparatus further including a charging system for producing a charge of the opposite polarity in said interface of the recording photoreceptor to maintain said latent electrostatic image on said outer dielectric layer of the recording photoreceptor.

14. The apparatus according to claim 13, wherein said charging system includes:

a charger device facing said outer dielectric layer upstream of the imaging device for equally charging the outer surface of the outer dielectric layer of the recording photoreceptor with charges of one polarity;

a first blanket illumination device for rendering said photoconductive layer conductive to inject compensation charges of said opposite polarity from said electrically-conductive layer to said interface between said outer dielectric layer and some photoconductive layer to produce in said interface charges of opposite polarity to the charges on said outer face of the outer dielectric layer of the recording photoreceptor; said imaging device discharging portions of said outer surface of the latter outer dielectric layer to produce said latent electrostatic image thereon;

a surface re-charger device coincident with said imaging device, which re-charger device neutralizes the charges in the light-exposed portions of the outer dielectric layer of the recording photoreceptor and in the light-exposed interface of the recording photoreceptor, such as to maintain said latent electrostatic image on said outer surface and said charge pattern or said interface patterns produced by the dark portions of said outer surface and interface after exposure by said imaging device;

and a second blanket illumination device facing said inner light-conductive electrically-conductive layer downstream of said imaging device for rendering said photoconductive layer of the recording photoreceptor conductive to inject compensation charges of said opposite polarity from the electrically-conductive layer of the recording photoreceptor to said interface between its outer dielectric layer and photoconductive to produce said charge pattern of opposite polarity in said interface.

15. The apparatus according to claim 12, wherein said recording photoreceptor further includes a transparent base on the inner surface of said electrically-conductive layer.

16. The apparatus according to claim 12, further characterized in that said transfer system includes:

a multi-layer transfer photoreceptor having an outer dielectric layer, an inner electrically-conductive layer, and an intermediate photoconductive layer forming an interface with said outer dielectric layer;

and a charging system for charging the outer surface of said outer dielectric layer of the transfer photoreceptor with charges of one polarity for facilitating the transfer of the toner image from the recording photoreceptor to the record member, and for producing in said interface, between the photoconductive layer and the outer dielectric layer, charges of the opposite polarity to maintain said charges of said one polarity on said outer surface of the transfer photoreceptor.

17. The apparatus according to claim 16, wherein said charging system of the transfer photoreceptor includes:

a charger device for charging the outer surface of said outer dielectric layer with said charges of one polarity;

and a blanket illumination device for rendering said photoconductive layer electrically-conductive to inject compensation charges of said opposite polarity from the electrically-conductive layer to said interface between said outer dielectric layer and said photoconductive layer.

18. The apparatus according to claim 12, wherein said outer dielectric layer of the recording photoreceptor is a laminated dielectric film.

19. The apparatus according to claim 12, wherein said transfer photoreceptor is also utilized for electrostatic separation of the record member from the recording photoreceptor.

20. The apparatus according to claim 12, wherein said transfer photoreceptor is also used for transporting the record member from the recording photoreceptor.

21. Electrophotographic printing apparatus for printing a plurality of copies form a single latent electrostatic image, comprising:

a recording photoreceptor having an outer surface capable of retaining a latent electrostatic image when formed thereon;

an imaging device for producing on said outer surface a latent electrostatic corresponding to the image to be printed;

a toner applicator for applying a toner to said outer surface to visually develop said latent electrostatic image as a toner image;

a transfer system for transferring said toner image from said recording photoreceptor to a record member;

a fixing system for fixing the transferred toner image on said record member;

and a cleaning system for cleaning the outer surface of said recording photoreceptor in preparation for receiving another latent electrostatic image to be printed;

characterized in that said recording photoreceptor is driven at a lower speed when recording said latent electrostatic image than when applying said toner, transferring the toner image, and fixing the toner image to the record member while printing a plurality of copies.

22. The apparatus according to claim 21, further characterized in that said transfer system includes:

a multi-layer transfer photoreceptor having an outer dielectric layer, an inner electrically-conductive layer, and an intermediate photoconductive layer forming an interface with said outer dielectric layer;

and a charging system for evenly charging the outer surface of said outer dielectric layer of the transfer photoreceptor with charges of one polarity for facilitating the transfer of the toner image from the recording photoreceptor to the record member, and for producing in said interface, between the photoconductive layer and the outer dielectric layer, charges of the opposite polarity to maintain said charges of said one polarity on said outer face of the transfer photoreceptor in the course of printing a plurality of copies.

23. The apparatus according to claim 22, wherein said charging system of the transfer photoreceptor includes:

a charger device for charging the outer surface of said outer dielectric layer with said charges of one polarity;

and a blanket illumination device for rendering said photoconductive layer electrically-conductive to inject compensation charges of said opposite polarity from the electrically-conductive layer to said interface between said outer dielectric layer and said photoconductive layer.

24. The apparatus according to claim 22, wherein said transfer photoreceptor is directly engageable with the record member and presses it against the outer surface of the recording photoreceptor during the transfer of the toner image therefrom to the record member.

25. The apparatus according to claims 21, when said recording photoreceptor is also of a multi-layer construction including an outer dielectric layer, an inner electrically-conductive layer, and an intermediate photoconductive layer forming an interface with said outer dielectric layer;

said imaging device producing a latent electric-static image of one polarity on the outer surface of said outer dielectric layer of the recording photoreceptor;

said apparatus further including a charging system for producing a charge pattern of the identical image but of opposite polarity in said interface of the recording photoreceptor to maintain said latent electrostatic image on said outer dielectric layer of the recording photoreceptor.

26. The apparatus according to claim 25, wherein said charging system of the recording photoreceptor includes:

a charger device upstream of the imaging device for depositing on the outer surface of the outer dielectric layer of thee recording photoreceptor charges of one polarity;

a first blanket illumination device for rendering said photoconductive layer conductive to inject compensation charges of said opposite polarity from said electrically-conductive layer to said interface between said outer dielectric layer and said photoconductive layer to produce in said interface charges of opposite polarity to the charges on said outer face of the outer dielectric layer of the recording photoreceptor;

said imaging device discharging portions of said outer surface of the latter outer dielectric layer to produce said latent electrostatic image therein;

a surface re-charger device coincident with said imaging device, which re-charger device neutralizes the charges in the light-exposed portions of the outer dielectric layer of the recording photoreceptor and in the light-exposed interface of the recording photoreceptor, such as to maintain said latent electrostatic image on said outer surface and said charge pattern or said interface patterns produced by the dark portions of said outer surface and interface after exposure by said imaging device;

and a second blanket illumination device downstream of said imaging device for rendering said photoconductive layer of the recording photoreceptor conductive to inject compensation charges of said opposite polarity from the electrically-conductive layer of the recording photoreceptor to said interface between its outer dielectric layer and photoconductive layer to produce said charge pattern of opposite polarity in said interface.

27. The apparatus according to claim 21, wherein said transfer photoreceptor is also utilized for electrostatic separation of the record member from the recording photoreceptor.

28. The apparatus according to claim 21, wherein said transfer photoreceptor is also used for transporting the record member from the recording photoreceptor.

29. A method of electrophotographic printing, comprising the following operations:

recording a latent electrostatic image on the outer surface of a recording photoreceptor corresponding to the image to be printed;

applying a charged toner to said outer surface to visually develop said latent electrostatic image as a toner image;

transferring said toner image from said recording photoreceptor to a record member;

fixing the transferred toner image on said record member;

and cleaning the outer surface of said recording photoreceptor in preparation for receiving another latent electrostatic image to be printed;

characterized in:

utilizing, in said transferring operation, a transfer photoreceptor;

and evenly charging the outer surface of said transfer photoreceptor with charges of one polarity such as to attract the charged toner on the recording photoreceptor to the record member.

30. The method according to claim 29, wherein said transferring operation:

a multi-layer transfer photoreceptor is utilized having an outer dielectric layer, an inner electrically-conductive layer, and an intermediate photoconductive layer forming an interface with said outer dielectric layer;

the outer surface of said outer dielectric layer of the transfer photoreceptor is evenly charged with charges of said one polarity of larger magnitude than the latent toner-receiving portions of the latent electrostatic image, for facilitating the transfer of the toner image from the recording photoreceptor to the record member; and charges of the opposite polarity are produced in said interface between the photoconductive layer and the outer dielectric layer to maintain said charges of said one polarity on said outer face of the transfer photoreceptor.

31. The method according to claim 30, wherein:

the outer surface of said outer dielectric layer is charged with said charges of one polarity;

and blanket illumination is applied to render said photoconductive layer electrically-conductive to inject compensation charges of said opposite polarity from the electrically-conductive layer to said interface between said outer dielectric layer and said photoconductive layer.

32. The method according to claim 29, wherein:

said recording photoreceptor is also of a multi-layer construction including an outer dielectric layer, an inner electrically-conductive layer, and an intermediate photoconductive layer forming an interface with said outer dielectric layer;

said imaging device produces a latent electrostatic image of one polarity on the outer surface of said outer dielectric layer of the recording photoreceptor;

and a charging system produces a charge pattern of the opposite polarity in said interface of the recording photoreceptor to maintain said latent electrostatic image on said outer dielectric layer of the recording photoreceptor.

33. The method according to claim 29, wherein said recording photoreceptor is driven at a lower speed when recording said latent electrostatic image then when transferring and fixing the toner image to the record member while printing a plurality of copies.

34. The method according to claim 29, wherein said transfer photoreceptor is utilized for record member transport.

35. The method according to claim 29, wherein said transfer photoreceptor is utilized for electrostatic separation of the record member from said recording photoreceptor.

36. The method according to claim 29, wherein said transfer photoreceptor has outer dielectric layer in the form of a laminated film.

37. The method according to claim 29, wherein said recording photoreceptor has an outer dielectric layer in the form of a laminated film.

* * * * *